United States Patent [19]

Segatz

[11] Patent Number: 5,025,959

[45] Date of Patent: Jun. 25, 1991

[54] APPARATUS FOR DISCHARGING PASTY MATERIALS, PARTICULARLY SEALING MATERIALS

[75] Inventor: Wilhelm Segatz, Zell u.A., Fed. Rep. of Germany

[73] Assignee: Ara-Werk Krämer GmbH & Co., Unterensingen, Fed. Rep. of Germany

[21] Appl. No.: 360,392

[22] Filed: Jun. 2, 1989

[30] Foreign Application Priority Data

Jun. 10, 1988 [DE] Fed. Rep. of Germany ... 8807574[U]

[51] Int. Cl.[5] ..... B67D 5/42

[52] U.S. Cl. ..... 222/389; 222/386.5; 222/334

[58] Field of Search ..... 222/389, 334, 386.5; 137/564.5; 189/39, 39.1, 40

[56] References Cited

U.S. PATENT DOCUMENTS

| | | | |
|---|---|---|---|
| 923,550 | 6/1909 | Mikorey | 222/389 |
| 1,878,115 | 9/1932 | DeCosse | 184/39 |
| 2,593,362 | 4/1952 | Taylor | 222/389 |
| 3,199,511 | 8/1965 | Kulick | 222/386.5 |
| 3,651,994 | 3/1972 | Nordenholt | 222/389 |
| 3,983,947 | 10/1976 | Wills et al. | 222/389 |
| 4,334,636 | 6/1982 | Paul | 222/334 |
| 4,826,050 | 5/1989 | Murphy et al. | 222/334 |

FOREIGN PATENT DOCUMENTS

| | | | |
|---|---|---|---|
| 280645 | 8/1988 | European Pat. Off. | 222/334 |
| 3409724 | 9/1985 | Fed. Rep. of Germany . | |
| 3514428 | 10/1986 | Fed. Rep. of Germany . | |
| 87050307 | 6/1987 | Fed. Rep. of Germany . | |
| 3607176 | 9/1987 | Fed. Rep. of Germany . | |
| 1371662 | 10/1974 | United Kingdom . | |
| 2078867 | 1/1982 | United Kingdom | 222/334 |

*Primary Examiner*—H. Grant Skaggs

*Attorney, Agent, or Firm*—Lackenbach Siegel Marzullo & Aronson

[57] ABSTRACT

An apparatus for discharging pasty materials, particularly sealing materials, has a cylinder for receiving the materials and an opening for the discharge thereof, a plunger axially displaceable in the reception cylinder by means of a flowable pressure medium, a device for supplying the pressure medium in a pressure cylinder and having a valve and a device for relieving the pressure in the pressure cylinder and having a valve. The pressure cylinder is filled with a liquid serving as the pressure medium and the pressure medium supply device and the pressure relief device are located in the liquid line. The liquid serving as the pressure medium can in particular be an oil. For producing the liquid or hydrostatic pressure the apparatus can have a pressure pump, such as e.g. a hydrostatic pressure pump, which is preferably spatially separated from the discharging apparatus and is connected to the latter by means of a hydrostatic pressure line. The pressure cylinder of the apparatus can in particular be constituted by a gas spring pressure cylinder. The part of the gas spring normally filled with gas is filled with the liquid and the gas spring push rod acts mechanically on the discharging apparatus plunger.

33 Claims, 3 Drawing Sheets

APPARATUS FOR DISCHARGING PASTY MATERIALS, PARTICULARLY SEALING MATERIALS

Figure 1:
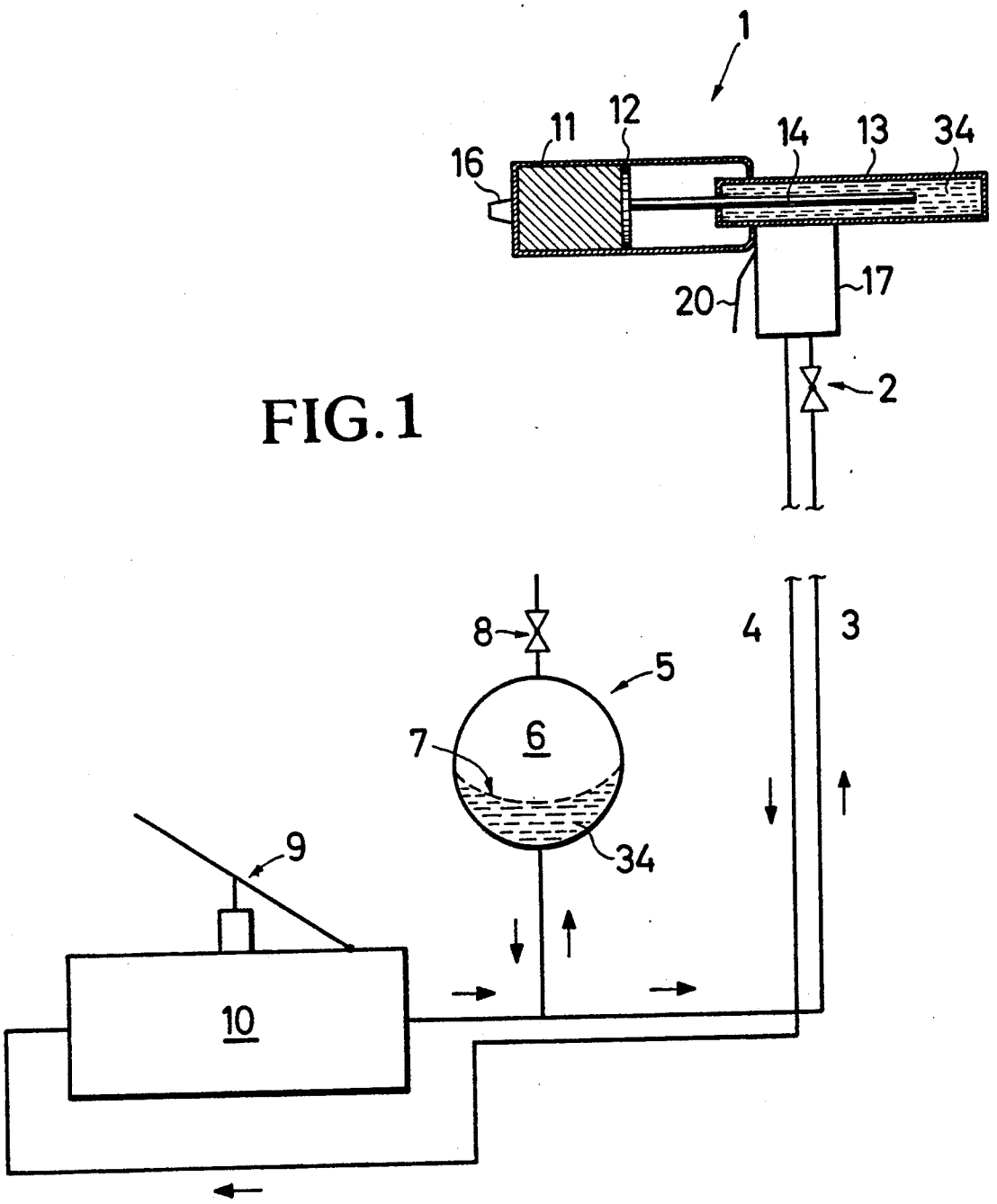

The invention relates to an apparatus for discharging pasty materials, particularly sealing materials, with a cylinder serving to receive the materials and an opening for the discharge of materials, a plunger axially displaceable in the reception by means of a flowable pressure medium (fluid), a device for supplying the pressure medium and provided with a valve and a device for relieving the pressure in the pressure cylinder provided with a valve.

In the case of apparatuses used for discharging pasty materials, the problem arises that after the end or after any interruption to the discharge process, material residues still pass out as a result of the pressure acting on the pasty materials. Apart from unnecessary material losses, this is particularly undesirable because, on each resumption of the discharge process, the outlet opening of the reception cylinder has to be cleaned.

In an apparatus according to DE-OS 34 09 724 use is made of a gas spring for discharging materials and as a result of which a plunger is axially displaceable. The dosage of the pasty materials takes place through the actual gas spring and optionally additionally by a manually operable valve arranged on the face of the reception cylinder.

German Utility Model 87 05 030.7 deals with the discharge of pasty materials located in tubular bags, the axially displaceable pressure block of the apparatus used for this purpose having a pressure relief spring.

The problem of the present invention is to prevent the exit of further materials at the end or on interrupting the discharging process. This is to take place in conjunction with a simple manipulation of the apparatus.

Surprisingly the invention solves this problem in a particularly advantageous manner in that the pressure cylinder is filled with a liquid serving as the pressure medium and the pressure medium supply device and the pressure relief device are arranged in the liquid line. As a result of this construction, due to the minimum expansion or compression of the liquid on removing the liquid or hydrostatic pressure, there is an immediate pressure relief, whilst there is an immediate pressurization on supplying minimum pressure medium volumes. The inventive apparatus is particularly suitable if the pressure medium is oil. As a result of the immediate pressure drop, a subsequent discharge of material is prevented. As a result of the immediate pressure build-up, e.g. after setting down or changing the discharge mechanism, the material can be directly further processed with a uniform discharge rate.

The inventive apparatus is advantageously so constructed that either the line for supplying the liquid or the pressure relief line is closed, when the other line is open.

According to a preferred embodiment of the invention the apparatus has a pressure pump, particularly a liquid or hydrostatic pressure pump, for producing the hydrostatic or liquid pressure. This pressure pump is preferably spatially separated from the discharging apparatus, the pressure pump and discharging apparatus being interconnected by means of at least one flexible hydrostatic pressure line. The discharging apparatus and the pressure pump can form a transportable unit according to the invention. In this unit the pressure pump is then preferably constructed as a standing apparatus. Appropriately the pressure pump is a mechanically operable pressure pump and can in particular be a foot pump.

According to the invention, the pressure pump is more particularly constructed for a pressure range of 120 to 400 bar and a preferred pressure range is 120 to 220 bar. For maintaining the hydrostatic pressure, the apparatus can be constructed in such a way that the liquid is pressed against a gas cushion in a gas pressure accumulator or reservoir. The liquid and gas cushion in said gas pressure reservoir are preferably separated by a diaphragm. By means of a valve located on the gas pressure reservoir, an adjustable gas supply pressure can be applied to the diaphragm, so that the hydrostatic pressure rises with respect to said gas supply pressure on operating the pressure pump. In order to obtain a uniform characteristic of the discharging process, it is advantageous if the gas volume in the gas pressure reservoir is large compared with the displacement volume of the piston in the pressure cylinder. The invention in particular prefers a gas volume in the gas pressure reservoir to piston displacement volume in the pressure cylinder ratio of at least 10:1 and preferably 20 to 50:1. According to the invention, the pressure pump can be dimensioned in such a way that following a complete discharge of material, 5 to 6 pressure pump strokes are sufficient to restore the initial pressure of the liquid, which was originally set with respect to the gas supply pressure.

According to a preferred embodiment of the invention, the pressure relief device is connected in substantially pressureless manner to a liquid storage tank by means of a line for the return of the liquid and which is in turn preferably connected to the hydrostatic pump, so that a closed liquid circuit is obtained. The liquid storage tank preferably forms a constructional unit with the pressure pump.

Advantageously, according to the invention the supply valve for opening and closing the liquid supply line and the pressure relief valve opening and closing the return line for the liquid are constructed as a structural unit. The supply valve and pressure relief valve can be mechanically coupled. This mechanical coupling can be realized within a constructional unit or be between spatially separated valves. The apparatus is preferably constructed in such a way that the pressure relief device is part of the mechanical operating device for the liquid supply. According to the invention, it is possible to provide the same operating member for operating the supply valve and the pressure relief valve and this is particularly constituted by a drain tap or cock. The supply valve is appropriately a ball valve, which has at least one valve seat. The ball can be mechanically disengaged and particularly raised from said ball seat counter to the pressure of the liquid. A separate valve seat can be provided for pressure relief and pressurizing and can be closed or opened by the same ball. These two valve seats can be arranged coaxially to one another and are preferably located on the same side of the ball. The valve seats are preferably axially displaceable relative to one another, so that an alternate raising of the balls from the valve seats is possible.

The pressure relief device can have a pipe length, which serves to raise the ball from the valve seat, which closes the liquid supply line, so that pressure medium can flow in.

The pipe length is preferably at least partly arranged in the line leading from the supply valve to the pressure cylinder. In such an apparatus it is particularly advantageous if the opening of the pipe length serving as the pressure relief line and associated with the ball simultaneously forms the valve seat for the pressure relief valve. Such a construction has a position during the pressure build-up in the pressure cylinder, in which the ball in the supply valve is raised out of its valve seat and is located on the pipe length opening acting as the valve seat of the pressure relief valve and closes the same. The position during the pressure relief in the pressure cylinder is characterized in that the ball in the supply valve is located in its seat and the opening of the pipe length acting as a valve seat for the pressure relief valve is exposed.

The reception cylinder can have an extension with the same internal diameter and which serves as a pressure cylinder, as described e.g. in German Utility Model 87 05 030.7, in which the two are separated by a plunger, which also serves as a piston. The pressure cylinder and piston can be provided in addition to the reception cylinder and plunger, the piston and plunger being operatively interconnected.

A particularly advantageous embodiment of the invention is obtained if the pressure cylinder is constituted by that of a gas spring, the gas spring part normally filled with gas being filled with the liquid. The gas spring push rod serves as the piston and acts mechanically on the plunger of the discharging apparatus. The gas spring is normally permanently filled with a gas and which substantially works with a constant pressure against the cross-section of a push rod. The pressure acting on the materials to be discharged, is dependent in this embodiment on the diameter of the gas spring push rod. In the case of a thick push rod a higher force acts on the materials to be discharged, whilst the force is lower in the case of a thin push rod. The invention can also be considered in such a way that the gas pressure is rearwardly displaced in a gas cushion, particularly in the gas pressure reservoir and the liquid acts as a non-compressible transfer medium. The construction of the apparatus, in which the inventive features are realized in combination with the liquid-filled pressure cylinder of a gas spring is particularly appropriate for solving the problem of the invention.

The liquid volume, which can be additionally introduced into the pressure cylinder on pressurizing, corresponds to the displacement volume of the piston. Appropriately the device for applying the liquid and for pressure relief has at least one opening in that part of the pressure cylinder which is filled with liquid. Preferably there is only one opening in the pressure cylinder for applying the liquid and for pressure relief. This opening is in particular radially passed through the cylinder wall. A supply line provided both for applying the liquid and for pressure relief, can be connected to said opening by a clamping connection. The device is advantageously constructed in such a way that the pressure cylinder is at least partly surrounded by an annular ring in the form of a cylinder jacket and which around the opening is bounded by two O-rings. This cylindrical space has an opening communicating with that in the pressure cylinder for the supply line coming from the valves.

The inventive apparatus can also be constructed in such a way that the liquid supply line contains a reducing valve for regulating the liquid flow. Considered in the flow direction, it is preferably located upstream of the supply valve in the pressure line. The reducing valve is provided particularly in the vicinity of the discharging apparatus.

The apparatus is preferably in the form of a delivery gun having a handle and a drain tap.

The apparatus is suitable for all pasty materials ranging from viscoplastic materials to foams. The materials can either be introduced and processed in the reception cylinder of the apparatus in loose form or packed, e.g. in cartridges or tubular bags. The discharging process takes place in such a way that on interruption or ending same, no further material residues escape, because as a result of the invention there is an immediate pressure relief despite an only limited liquid return flow quantity. In addition, discharge takes place with an adjustable speed and in a very uniform manner. Further advantages are that the small liquid quantities which occur and the preferred use of a mechanically operable pressure pump have an energy-saving effect. As no compressed air is used, the materials are discharged in a completely noiseless manner. Additional, manually operable material valves, such as can be provided for preventing an undesired material discharge, e.g. when using a gas spring alone, are not required in the case of the present invention.

Further features and details of the invention can be gathered from the following description of preferred embodiments, in conjunction with the subclaims and drawings. The features can be realized individually or in the form of combinations. The invention is not limited to the construction shown in the drawings and as described hereinafter. In the drawings show:

FIG. 1: A diagrammatic representation of an inventive apparatus.

Figure 2:
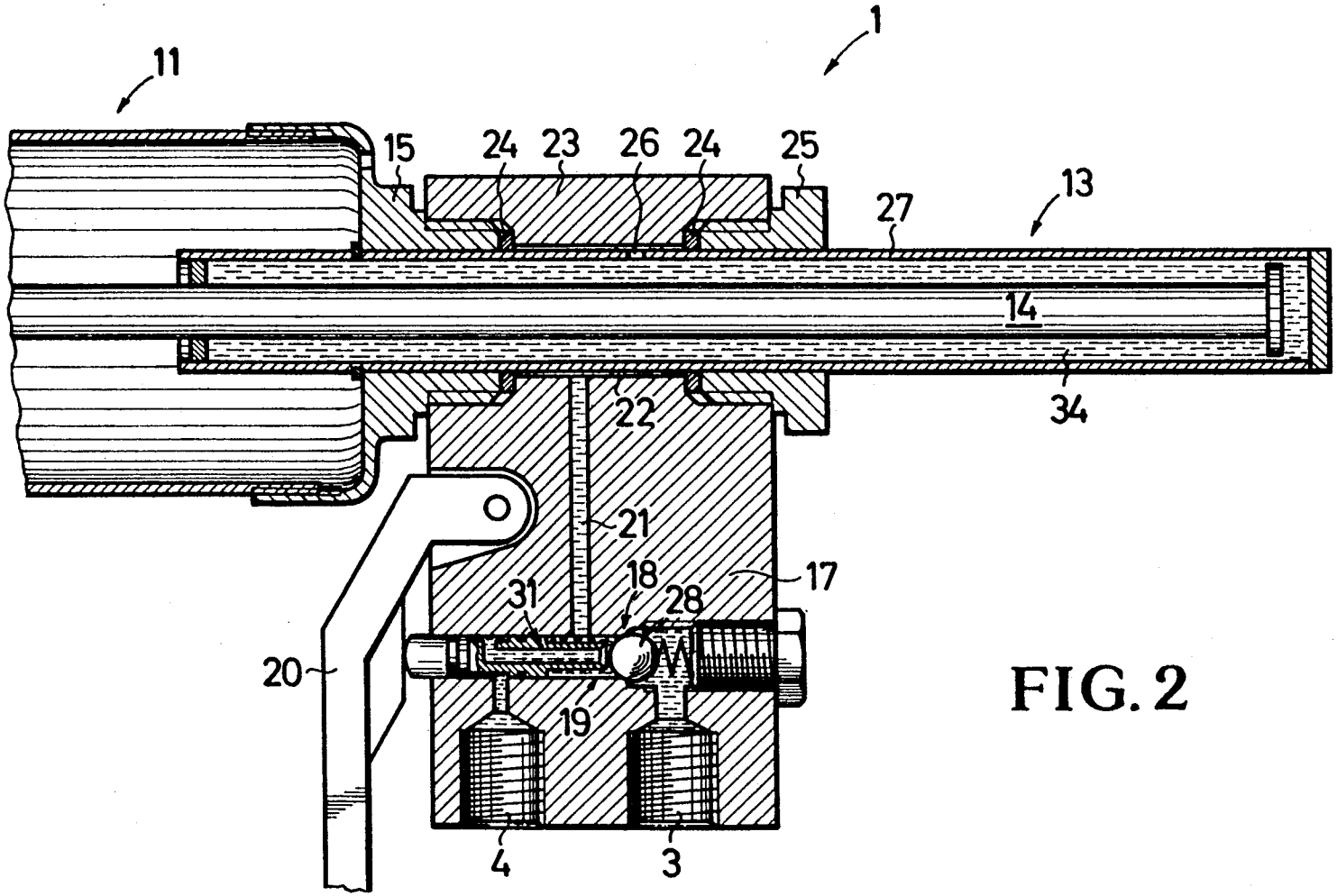

FIG. 2: A partly broken away longitudinal section through a delivery gun.

Figure 3B:
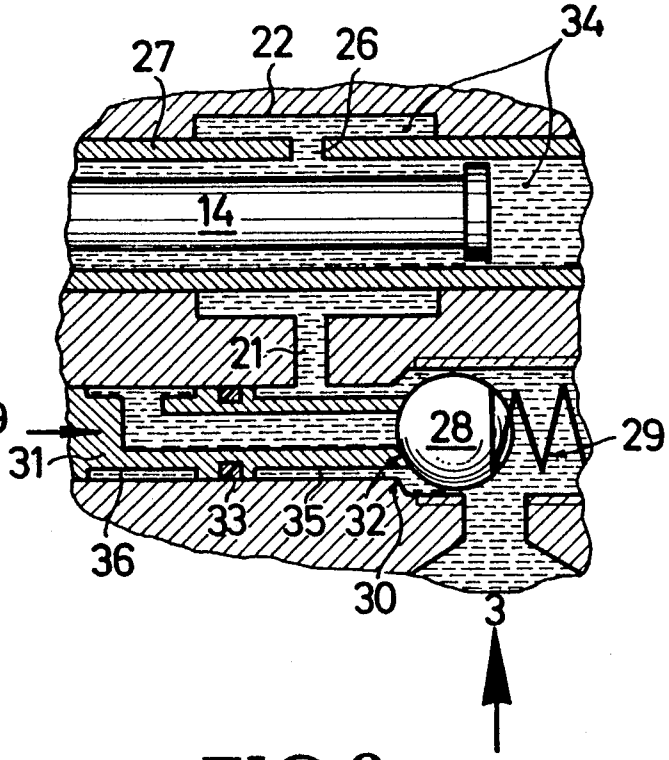
Figure 3A:
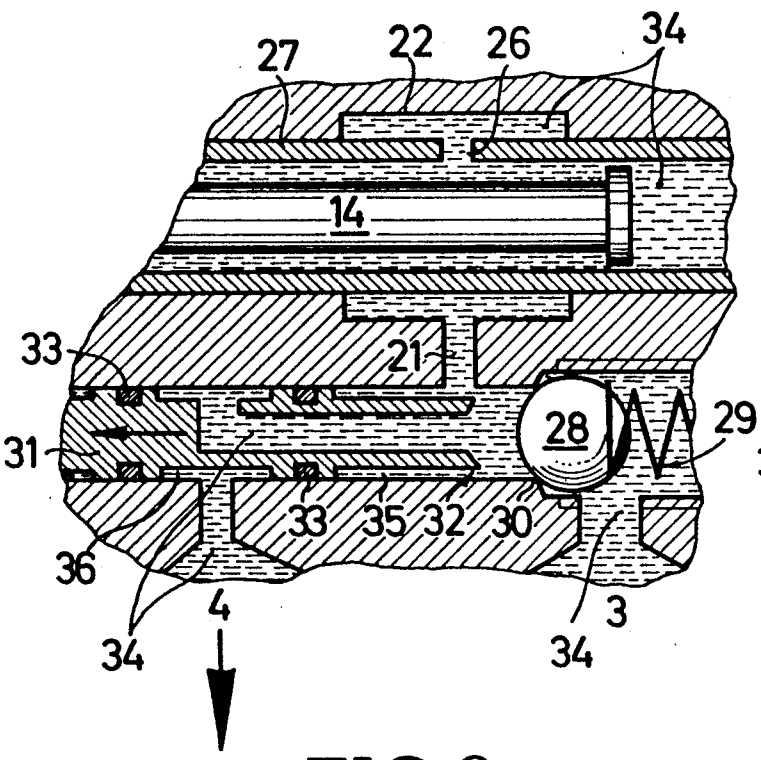

FIGS. 3*a* and 3*b*): The valve arrangement of the delivery gun on a larger scale than in FIG. 2 a) on pressure relief b) on pressurizing.

The apparatus according to FIG. 1 comprises a discharge or delivery gun 1 with a handle 17 and a drain tap or cock 20, which is additionally provided in the vicinity of handle 17 with a reducing valve 2. The delivery gun 1 has a push rod 14 in a pressure cylinder 13, as well as a plunger 12 in a reception cylinder 11, on whose end facing the handle 17 is located either on the apparatus or on an insertable cartridge, a discharge nozzle 16. The end of the push rod 14 directed towards discharge nozzle 16 is directly connected to the plunger 12. FIG. 2 shows in more detail and in longitudinal sectional form part of the delivery gun 1.

FIG. 1 also shows an oil storage tank 10 having a foot pump 9 for oil pressure production. A gas pressure reservoir is provided, which is linked with the pump. As a result the oil pressure produced with the foot pump 9 can be produced against a gas cushion 6 located in the gas pressure reservoir 5. The latter contains a diaphragm 7 for separating gas and oil. A valve 8 is also located on reservoir 5. This valve makes it possible to produce and vary the gas supply pressure against the which the oil pressure is built up. A supply pressure line 3 connects the storage tank 10 and the gas pressure reservoir 5 to the handle 17 of delivery gun 1, whilst a parallel twin line connects as the return line 4 handle 17 of gun 1 to the storage tank 10. The supply line 3 supplies the pressurized oil from storage tank 10 or gas pressure reservoir 5 to the handle 17 of discharge gun 1 and the return line 4 is used for returning the pressure-relieved oil from handle 17 of delivery gun 1 to the storage tank 10. Thus, the arrangement is in the form of a closed oil circuit, the line length between the pump means and the gun being 3 to 5 m.

FIG. 2 is a vertical partial longitudinal section through the delivery gun 1, which has a handle 17 with a valve trigger 20. Handle 17 contains a valve unit having in mechanically coupled manner a supply valve 18 and a pressure relief valve 19 and which is manually operable by means of the valve trigger 20. The valve unit is shown in even greater detail in FIGS. 3*a*) and 3*b*). As shown in FIG. 2, on the underside of handle 17 are provided screw connections for connecting the supply line 3 and handle 17 or return line 4 and handle 17. On the side of handle 17 having the valve trigger 20 is provided the reception cylinder 11 for the pasty materials, but is only partly shown in FIG. 2. This reception cylinder 11 contains the plunger 12, which is connected to the push rod 14 of the pressure cylinder 13 filled with oil 34. Cylinder 13 constitutes the cylinder of a gas spring of the type normally permanently filled with a gas and which works with a substantially constant pressure against the cross-section of a push rod. As such gas springs are mass produced articles, they can be used inexpensively and in space-saving manner for the invention. Whereas these gas springs are normally filled with a constant gas quantity and are completely sealed, the casing of such a "gas-spring" is filled with oil according to the invention and provided with a supply line. The space filled with the pressure medium, in this case oil, is shown in cross-lined form in FIG. 2.

Unlike in the case of a normal construction of such a gas springs, according to the invention as a result of the filling with oil it is constructed in such a way that the gas pressure cushion 6 is rearwardly displaced in the gas pressure reservoir 5. Thus, the oil 34 constitutes a transfer medium. Therefore the pressure cylinder 13 comprises the casing of the oil-filled gas spring and the gas spring push rod 14 is the piston. Despite the small cross-section of push rod 14, this arrangement makes it possible to obtain high, constant forces for discharging the materials, because the pressure in the system can be very high and the gas volume in the gas pressure reservoir can be kept large. There is no longer any need to provide braking means for the push rod, because immediately no pressure acts on said rod in the case of pressure relief. Thus, the resilience or recovery of the materials to be discharged can act on the rod, so that no residual material passes out through the discharge nozzle and said residual material is pressure-relieved. Despite the large gas volume in the gas pressure reservoir, the discharging apparatus remains easy to handle, because the delivery gun is spatially separated from the oil pressure producing means.

Also is also shown in FIG. 2, the pressure cylinder 13 is connected to the reception cylinder 11 by means of a screw connection 15. A pressure line 21 connects the valve unit in handle 17 and which contains the supply valve 18 and pressure relief valve 19, to a cylindrical annular space 22 in the upper part 23 of handle 17, which surrounds part of the pressure cylinder 13. This annular space 22 is formed by a clamping connection round pressure cylinder 13 and is sealed with two O-rings. The clamping connection is provided by means of the screw connection 15 and by means of a further screw connection 25 on the opposite side of upper part 23 and is also used for fixing the pressure cylinder 13. Annular space 22 connects line 21 and a radial opening 26 in pressure cylinder 13. Thus, said opening 26 is located in that part of the pressure cylinder wall 27, which is surrounded by the oil-filled, cylindrical annular space 22. Through this opening 26 in the pressure cylinder wall 27, by means of the valve unit shown in FIGS. 3*a*) and 3*b*) the oil located in pressure cylinder 13 can either be oil pressurized or pressure-relieved.

The valve unit containing supply valve 18 and pressure relief valve 19 is shown in FIG. 3. The valve unit is a ball valve, in which a valve ball 28 serves as the valve element for both valves. Each valve 18 or 19 has a hemispherical valve seat 30 or 32, both valve seats being movable relative to one another. Thus, one or other valve seat can be sealed in alternate manner with the ball. Valve seat 30 is arranged in fixed manner in the valve casing and forms the valve seat for supply line 21 to the pressure cylinder 13. The second valve seat 32 is constructed in movable manner and forms the face of a pipe length 31, whose interior communicates with the return line 4. The supply line 21 to the pressure cylinder 13, which issues into a cylindrical annular space 22 around part of the pressure cylinder 13, is consequently alternately connected to the interior of the pipe length 31 and therefore with the return line 4, or to the supply line 3. FIG. 3*a* shows the state when the oil in pressure cylinder 13 is pressure-relieved and FIG. 3*b* the state in which the oil in the pressure cylinder 13 is pressurized. In FIG. 3*a*, in which the valve unit is in the pressure-relieved state, the ball 28 in supply valve 18 is pressed by spring 29 and the oil pressure prevailing in the supply line into the valve seat 30, so that the pressure cylinder 13 is blocked off from the supply line 3. The pipe length 31 is so arranged in the line between the supply valve 18 and the pressure relief valve 19, that the frontal opening associated with ball 28 and which serves as the valve seat 32 for the pressure relief valve 19 is exposed. Thus, a connection from the pressure cylinder 13 to the return line 4 is produced through the interior of the pipe length 31 and via a cylindrical annular space 36 surrounding the same. As a result of this arrangement, through an oil return flow the pressure relief in pressure cylinder 13 can take place. Suitable O-rings 33 are provided for sealing purposes between the line wall and the pipe length.

FIG. 3*b* shows the state of the valve unit comprising supply valve 18 and pressure relief valve 19 when the oil in pressure cylinder 13 is pressurized. In this case, the pipe length 31 is so displaced in the direction of ball 28 by manual operation of the drain tap 20, that the ball is pressed into the opening of pipe length 31 serving as the valve seat 32 of pressure relief valve 19 and ball 28 is simultaneously raised against the pressure of spring 29 and the oil pressure prevailing in the supply line out of the valve seat 30 of the supply valve 18. Thus, there is a connection between the pressure cylinder 13 and the supply line 3 around ball 28 by means of the annular space 35 surrounding pipe length 31 and the line 21.

I claim:

1. Apparatus for discharging pasty materials comprising a reception cylinder for receiving said materials having an opening for the discharge of said materials therefrom;

a plunger arranged within said reception cylinder to be axially displaceable therein by a pressurized liquid medium acting thereon;

a pressure cylinder for containing pressurized liquid medium coupled to said plunger so that the presence of pressurized liquid medium in the pressure cylinder will axially displace said plunger, liquid medium pressurizing means spaced away from said pressure cylinder and reception cylinder;

a flexible hydrostatic pressure line for carrying liquid medium under pressure having a supply portion and a return portion both of said portions being in communication with said liquid medium pressurizing means;

valving means remote from said liquid medium pressurizing means for alternately connecting the supply portion or the return portion of said hydrostatic pressure line to said pressure cylinder; and a reservoir for containing pressurized gas to maintain hydrostatic pressure in said hydrostatic pressure line in communication with said supply portion of said hydrostatic pressure line at a location intermediate said liquid medium pressurizing means and said valving means.

2. Apparatus according to claim 1, characterized in that the liquid serving as the pressure medium is an oil (34).

3. Apparatus according to claim 1, characterized in that when the supply portion of the flexible hydrostatic pressure line is closed, the pressure relief line (4) is open and vice versa.

4. Apparatus according to claim 1 characterized in that the reception cylinder and the liquid medium pressurizing means from a transportable unit.

5. Apparatus according to claim 4, characterized in that the liquid medium pressurizing means is constructed as a free standing apparatus.

6. Apparatus according to claim 1, characterized in that the liquid medium pressuring means is a mechanically operable foot pressure pump.

7. Apparatus according to claim 6, characterized in that the pressure pump (9) is constructed for a pressure range of 120 to 400 bar.

8. Apparatus according to claim 1, characterized in that a gas cushion (6) is provided in said reservoir, which is used for maintaining the pressure in the hydrostatic line.

9. Apparatus according to claim 8, characterized in that the liquid medium pressurizing means and the gas cushion are separated from one another by a diaphragm.

10. Apparatus according to claim 8, characterized in that the gas supply pressure in the reservoir is adjustable.

11. Apparatus according to claim 8, characterized in that the gas volume in the reservoir is at least 10 times greater than the displacement volume of the plunger of the reception cylinder.

12. Apparatus according to claim 1, characterized in that the liquid medium pressurizing means is dimensioned in such a way that 5 to 6 pressure pump strokes are sufficient for restoring the initial pressure thereof.

13. Apparatus according to claim 1, in that a pressure relief device is connected with the liquid medium pressurizing means via the hydrostatic line.

14. Apparatus according to claim 13, characterized in that the pressure relief device is a means for the supply of liquid.

15. Apparatus according to claim 1, characterized in that a supply valve (18) for opening and closing the liquid supply line (3) and a pressure relief valve (19) for opening and closing the liquid return line (4) are constructed as a structural unit in said valving means.

16. Apparatus according to claim 15, characterized in that the supply valve (18) and the pressure relief valve (19) are operable by a common operating member.

17. Apparatus according to claim 16, characterized in that the operating member is valve trigger (20).

18. Apparatus according to claim 15 characterized in that the supply valve (18) is a ball valve with at least one valve seat (30) from which the ball (28) can be mechanically disengaged counter to the hydrostatic pressure.

19. Apparatus according to claim 18, characterized in that in each case one valve seat (30, 32) is provided for pressurization and pressure relief and each valve seat can be opened or closed by the same ball (28).

20. Apparatus according to claim 19, characterized in that the valve seats (30, 32) are constructed coaxially to one another and are located on the same side of ball (28).

21. Apparatus according to claim 18, characterized in that the pressure relief device (19, 32) has a pipe length (31), which is provided for raising the ball (28) out of the valve seat (30) closing liquid supply to the pressure cylinder.

22. Apparatus according to claim 21, characterized in that the pipe length (31) is at least partly arranged between supply valve (18) and pressure cylinder (13).

23. Apparatus according to claim 21, characterized in that an opening is provided in pipe length (31) serving as the pressure relief line facing ball (28) forms the valve seat (32) for the pressure relief valve (19).

24. Apparatus according to claim 23, characterized in that in the case of pressurization in pressure cylinder (13), the ball (28) in supply valve (18) is raised out of its valve seat (30) and is located on the opening of pipe length (31) serving as the valve seat (32) for the pressure relief valve (19).

25. Apparatus according to claim 23, characterized in that in the case of pressure relief in pressure cylinder (13), the ball (28) in supply valve (18) is located in its valve seat (30) and the opening of the pipe length (31) serving as the valve seat (32) of the pressure relief valve (19) is exposed.

26. Apparatus according to claim 1, characterized in that a supply valve (18) and a pressure relief valve (19) are mechanically coupled together in said valving means.

27. Apparatus according to claim 1, characterized in that the pressure cylinder (13) liquid and a push rod (14) acts mechanically on the plunger (12).

28. Apparatus according to claim 1, characterized in that the pressure cylinder (13) has at least one opening (26) for the application of the liquid and for pressure relief.

29. Apparatus according to claim 28, characterized in that the opening (26) passes radially through cylinder wall (27).

30. Apparatus according to claim 28 characterized in that the hydrostatic pressure line is connected by a clamping connection to an opening in the pressure cylinder.

31. Apparatus according to claim 28, characterized in that the pressure cylinder (13) is surrounded by two O-rings (24) bounding a cylinder jacket-like annular space (22) around the opening (26) and which has an opening for supply line (21) communicating with the opening (26) in pressure cylinder (13).

32. Apparatus according to claim 1, characterized in that a reducing valve (2) for regulating the liquid flow is provided in the supply portion.

33. Apparatus according to claim 1, characterized in that it is constructed in part as a delivery gun (1) with a handle (17) and a valve trigger (20).

* * * * *